United States Patent [19]

Bullock et al.

[11] 4,003,318

[45] Jan. 18, 1977

[54] REINFORCED BOLSTER POCKET WALL

[75] Inventors: Robert L. Bullock, Lombard; Robert P. Geyer, Palatine, both of Ill.

[73] Assignee: Standard Car Truck Company, Chicago, Ill.

[22] Filed: June 25, 1975

[21] Appl. No.: 590,293

[52] U.S. Cl. ..... 105/226; 105/197 DB; 105/207

[51] Int. Cl.[2] ..... B61F 5/12; B61F 5/16; B61F 5/24; B61F 5/50

[58] Field of Search ..... 105/197 DB, 202, 207, 105/226

[56] References Cited

UNITED STATES PATENTS

| | | | |
|---|---|---|---|
| 2,053,990 | 9/1936 | Goodwin | 105/197 DB |
| 3,127,850 | 4/1964 | Clasen | 105/197 DB |
| 3,802,353 | 4/1974 | Korpics | 105/197 DB |
| 3,837,293 | 9/1974 | Neumann et al. | 105/202 |
| 3,855,942 | 12/1974 | Mulcahy | 105/197 DB |
| 3,857,341 | 12/1974 | Neumann | 105/197 DB |

*Primary Examiner*—Robert J. Spar
*Assistant Examiner*—Howard Beltran
*Attorney, Agent, or Firm*—Kinzer, Plyer, Dorn & McEachran

[57] ABSTRACT

A bolster for use in a stabilized railroad car truck has stabilizer pockets on each side of each end. Portions of the bolster adjacent the pockets extend above the bolster top wall. There are reinforcing means for each bolster pocket positioned generally at the midpoint of each pocket and within the bolster structure.

1 Claim, 7 Drawing Figures

Fig. 5.
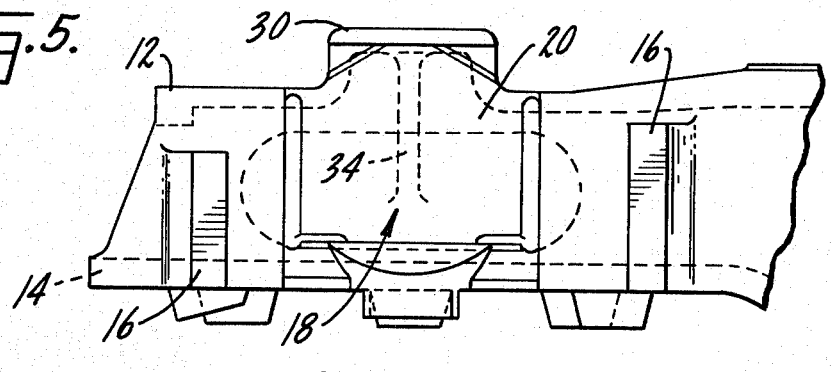
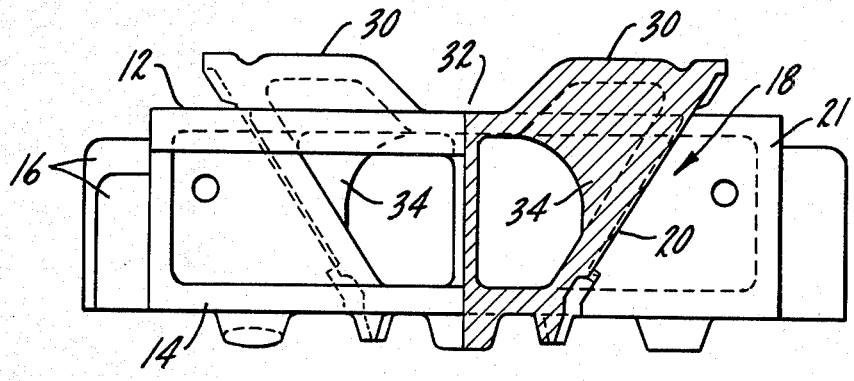
Fig. 6.
Fig. 7.
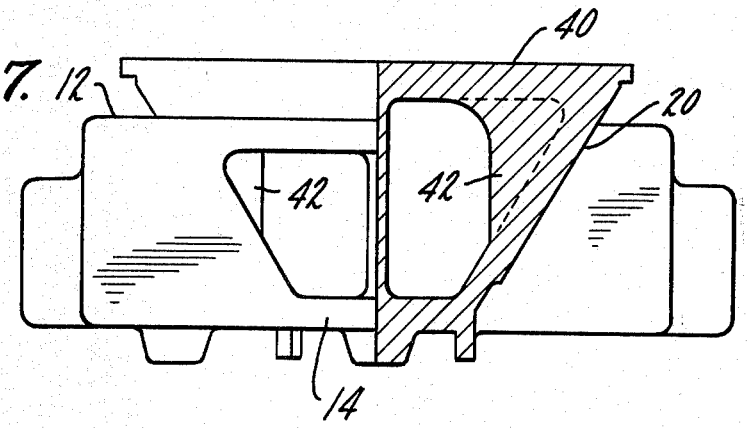

REINFORCED BOLSTER POCKET WALL

SUMMARY OF THE INVENTION

The present invention relates to improvements in stabilized railroad car trucks and particularly to means for reinforcing the bolster pocket.

A primary purpose of the invention is a stabilized railroad car truck bolster having a reinforcing rib for each bolster pocket.

Another purpose is a bolster structure of the type described including a reinforcing rib, integral with the bolster slanted pocket wall and positioned generally behind each pocket.

Another purpose is a bloster structure of the type described including means for reinforcing that portion of the bolster which extends above its top wall adjacent the area of the stabilizing pocket.

Other purposes will appear in the ensuing specification, drawings and claims.

BRIEF DESCRIPTION OF THE DRAWINGS

The invention is illustrated diagrammatically in the following drawings wherein:

FIG. 5 is a side view of the bolster of FIG. 4,

FIG. 6 is a section along plane 6—6 of FIG. 4, and

FIG. 7 is an end view, in part section, showing a further modified form of bolster structure.

DESCRIPTION OF THE PREFERRED EMBODIMENT

Figure 1:
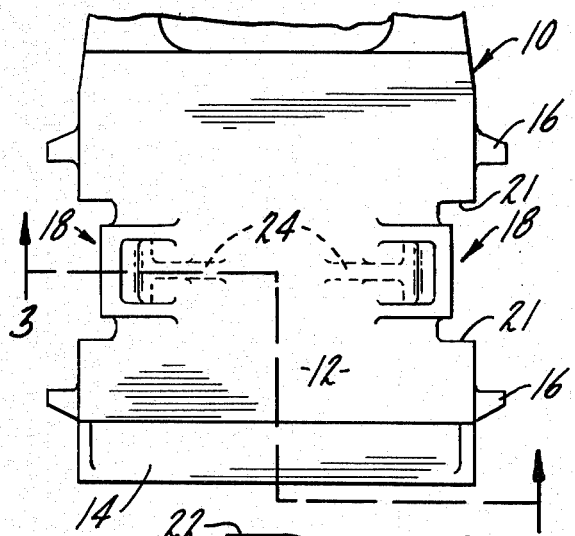
FIG. 1 is a top view of a portion of a railroad car truck bolster.

Recent observations in the field have disclosed a number of railroad car truck side frames in which the dimensions between the column wear plates was found to be slightly smaller at the top than at the bottom. The difference has been found to be as much as ⅛ inch, with a large number having a difference of approximately 1/16 inch. This difference has been attributed to the manner in which the side frame casting cools. Because of this dimensional difference, there is substantially more wedging force applied at the top of the wedge than at the bottom. In fact, the magnitude of the wedging force increase can be as great as ten times the normal wedging force which would be applied if there was equal spacing between the top and bottom of the column wear plate. The increase in force is applied to the wedge and to the top of the bolster area where both the wedge and the bolster are least able to support the force increase.

The increased wedging force has caused failure at the top of the bolster pocket, particularly that portion of the bolster which extends above the top wall of the bolster. Not only have there been field failures because of the excessive wedging force at the top of the bolster pocket, but there is substantially more wear on the top half of the sloping or slanted surface of the bolster pockets than on the lower or bottom half.

The present invention is specifically directed to reinforcing the bolster pocket and particularly that portion of the bolster pocket which may extend above the bolster top wall.

In the drawings we have only shown the bolster. It should be understood, however, that the bolster will conventionally be placed within the window of a railroad car truck side frame and that it will be supported within the window by conventional load springs. There are stabilizing pockets on each side of the bolster and these will conventionally contain wedges which will apply a damping force between the bolster and side frame.

Figure 2:
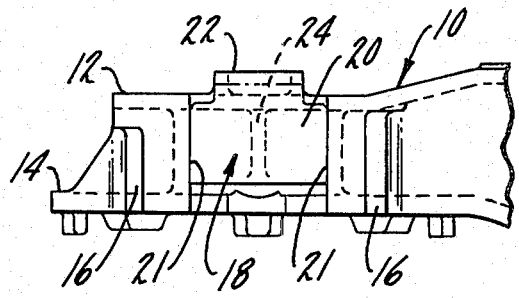
FIG. 2 is a side view of the structure of FIG. 1.
Figure 3:
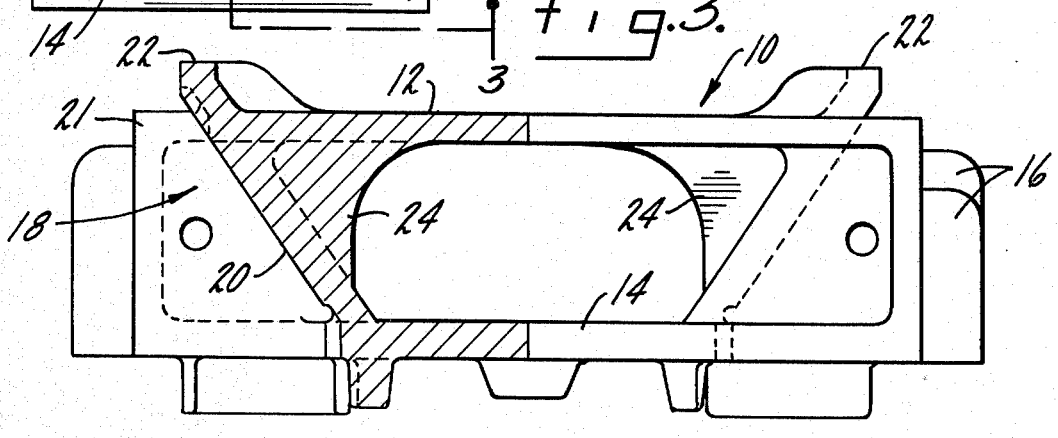
FIG. 3 is a section along plane 3—3 of FIG. 1.

In the structure shown in FIGS. 1, 2 and 3, a bolster 10 has a top wall 12, a bottom wall 14 and conventional laterally extending lugs 16 which will be positioned on opposite sides of the side frame. There are bolster pockets 18 on each side of the bolster with the rear of each pocket being defined by a slanted wall 20. The pockets 18 have side walls 21. Portions of the bolster, indicated at 22, extend above the top wall 12 of the bolster, for example as shown in U.S. Pat. No. 3,127,850. Conventionally, stabilizing wedges will be positioned within pockets 18.

As indicated above, there has been shown to be an increase in wear on the slanted surface 20 of the bolster pocket and in particular on bolster extension 22 which extends above the bolster top wall. To reinforce the bolster pocket, a rib 24 has been formed integral with slanted wall 20 and integral with top wall 12 of the bolster. Ribs 24, as particularly shown in FIGS. 1 and 2, are positioned generally midway or at the midpoint of pocket 18 and are positioned directly behind the pocket to provide reinforcement for the pocket.

Figure 4:
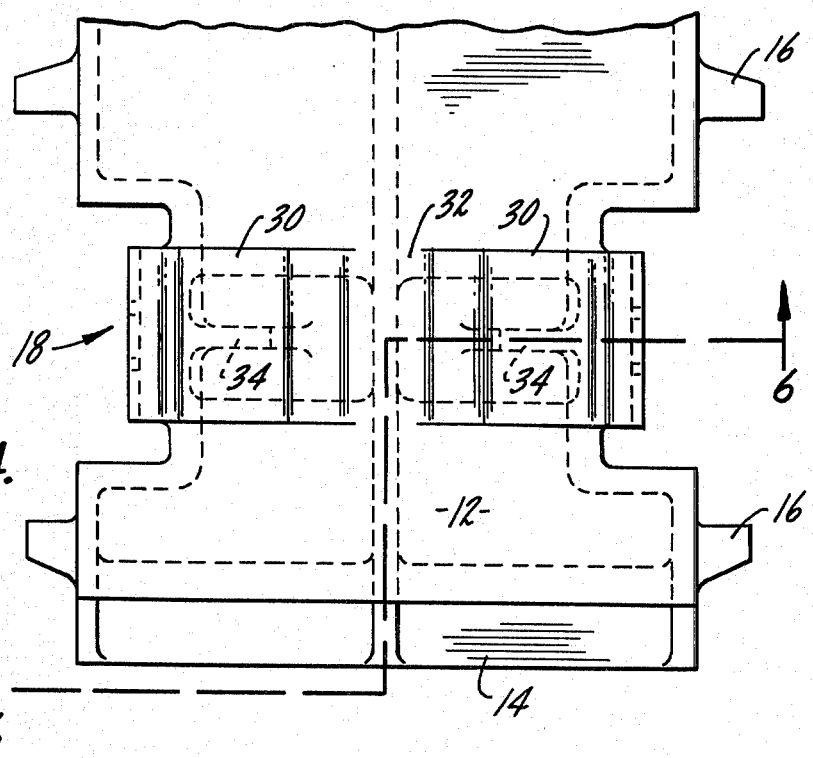
FIG. 4 is an enlarged top view of a modified form of bolster.

In the structure of FIGS. 4, 5 and 6, like parts have been given corresponding numbers. The bolster extension, or that portion of the bolster which extends above top wall 12, has been itself extended laterally or in a direction perpendicular to the longitudinal axis of the bolster to define reinforcing areas 30. Note that there is a gap 32 between adjacent areas 30 and that areas 30 do not extend totally across the top of the bolster. Inside of the bolster, and integral with areas 30 and slanted walls 20 forming bolster pockets 18, are ribs 34. Ribs 34 perform the same reinforcing function as ribs 24 in the structures of FIGS. 1, 2 and 3. In this case, however, the ribs extend above the top wall 12 of the bolster and thus more fully reinforce that portion of the bolster which extends above its top wall. Reinforcing areas 30 provide additional strength for the bolster extension by extending themselves generally toward the center of the bolster and by permitting the reinforcing rib to rise within that portion of the bolster which extends above its top wall.

In the structure of FIG. 7, that portion of the bolster indicated at 40 which extends above top wall 12, extends entirely across an end of the bolster in the area of the bolster stabilizing pockets. Thus, there is no gap as indicated at 32 in the structures of FIGS. 4, 5 and 6. Rather, there is a laterally extending reinforcing structure completely across the top wall of the bolster. Positioned within the bolster are integral reinforcing ribs 42 which again will extend above the plane of the top wall of the bolster and will reinforce the member 40 as well as reinforce the slanted walls 20 of the bolster pockets. Ribs 42 are positioned at the midpoint of the bolster pockets, as are ribs 34 and 24. What is desirable is to provide adequate reinforcement without adding an excessive amount of weight to the bolster casting.

In all forms of the invention the bolster pocket is reinforced by a centrally disposed rib so as to prevent failure of the bolster pocket caused by the described increased wedging force. In the structure of FIG. 7, as in the structure of FIGS. 4, 5 and 6, the reinforcement extends above the plane of the bolster top wall and thus reinforces that portion of the bolster which normally will receive substantially increased wedging force.

Whereas the preferred form of the invention has been shown and described herein, it should be realized that there may be many modifications, substitutions and alterations thereto.

The embodiments of the invention in which an exclusive property or privilege is claimed are defined as follows:

1. A bolster for use in a stabilized railroad car truck, said bolster having a top wall and stabilizer pockets on each side of each end thereof, each of said pockets including a slanted interior wall, portions of said bolster adjacent said pockets extending above said top wall, and reinforcing means for said bolster pocket slanted interior walls positioned generally at the midpoint of each pocket and generally inside of said bolster, said reinforcing means including a rib behind each pocket and inside of said bolster, said ribs extending generally inwardly from each pocket and generally perpendicular to the longitudinal axis of said bolster, those portions of said bolster which extend above said top wall extending generally toward the longitudinal axis of said bolster for a substantial portion of the distance between said positions to form spaced projections above said bolster top wall, with said reinforcing ribs extending above the area of the bolster top wall and being inside of and integral with said projections and said slanted walls to thereby reinforce said projections against excessive wedging force applied thereto above the area of said bolster top wall.

* * * * *